US012251058B2

(12) United States Patent
Tyroler

(10) Patent No.: US 12,251,058 B2
(45) Date of Patent: Mar. 18, 2025

(54) WINDOW CLEANING DEVICE

(71) Applicant: TYROLER LTD., Neve Yamin (IL)

(72) Inventor: Dan Tyroler, Yesod HaMa'ala (IL)

(73) Assignee: TYROLER LTD., Neve Yamin (IL)

( * ) Notice: Subject to any disclaimer, the term of this patent is extended or adjusted under 35 U.S.C. 154(b) by 41 days.

(21) Appl. No.: 18/033,510

(22) PCT Filed: Oct. 21, 2021

(86) PCT No.: PCT/IL2021/051249
§ 371 (c)(1),
(2) Date: Apr. 24, 2023

(87) PCT Pub. No.: WO2022/085004
PCT Pub. Date: Apr. 28, 2022

(65) Prior Publication Data

US 2023/0389759 A1 Dec. 7, 2023

(30) Foreign Application Priority Data

Oct. 25, 2020 (IL) ..... 278265

(51) Int. Cl.
*A47L 1/12* (2006.01)

(52) U.S. Cl.
CPC ..... *A47L 1/12* (2013.01)

(58) Field of Classification Search
CPC ..... A47L 1/03; A47L 1/12; A47L 1/13
(Continued)

(56) References Cited

U.S. PATENT DOCUMENTS 2,668,975 A * 2/1954 Narajowski ..... A47L 1/12 15/220.2
2,774,983 A * 12/1956 Crowther ..... A47L 13/022 15/245

(Continued)

FOREIGN PATENT DOCUMENTS

CN 2263961 Y 10/1997
CN 2669777 Y 1/2005

(Continued)

OTHER PUBLICATIONS https://www.youtube.com/watch?v=SMI_AiEa0Jg&feature=emb_title&ab_channel= TyrolerBrightTools; 2017.

(Continued)

*Primary Examiner* — Randall E Chin
(74) *Attorney, Agent, or Firm* — Maschoff Brennan

(57) ABSTRACT

The present disclosure discloses a window cleaning device. The device is constituted by two cleaning units, each is configured to be attached to a different side of the window due to attraction force of the other cleaning unit. The attraction force is applied by magnetic members that are embedded in each of the cleaning units and each of them is configured to be magnetically coupled with at least one magnetic member of the other unit. Once the cleaning units are attached to the window, the window is engaged either by integral wipers of the cleaning unit and/or cleaning cloths attachable to the cleaning units to perform the cleaning process by the device. The cleaning units are each a single-piece molded article made of rubber, silicone rubber, elastomeric material or a thermosetting material, namely a relatively soft material, softer than the plastic material forming the known window cleaning devices.

16 Claims, 4 Drawing Sheets

(58) Field of Classification Search
USPC ..... 15/121, 220.1
See application file for complete search history.

(56) References Cited

U.S. PATENT DOCUMENTS

| | | | | |
|---|---|---|---|---|
| 2,852,798 | A | 9/1958 | Grossfeld | |
| 3,731,337 | A * | 5/1973 | Doyel | A47L 1/12 15/220.2 |
| 3,766,591 | A | 10/1973 | Soito | |
| 5,515,570 | A | 5/1996 | Muscroft | |
| 2009/0106925 | A1 | 4/2009 | Cheyne | |
| 2014/0332030 | A1 * | 11/2014 | Trudeau | A47L 1/09 134/6 |
| 2015/0027493 | A1 | 1/2015 | Baek | |

FOREIGN PATENT DOCUMENTS

| | | | | |
|---|---|---|---|---|
| CN | 202458192 | U | 10/2012 | |
| CN | 103479286 | A | 1/2014 | |
| CN | 106691302 | A * | 5/2017 | |
| CN | 208655135 | U | 3/2019 | |
| CN | 210077541 | U | 2/2020 | |
| CN | 211066389 | U | 7/2020 | |
| CN | 217365621 | U | 9/2022 | |
| EP | 0811349 | A1 | 12/1997 | |
| JP | H04352924 | A | 12/1992 | |
| KR | 100299526 | B1 * | 10/2001 | |
| KR | 20060008649 | A | 1/2006 | |
| KR | 101183116 | B1 | 9/2012 | |
| KR | 20130019808 | A | 2/2013 | |
| WO | WO-2006095229 | A1 * | 9/2006 | A47L 1/09 |

OTHER PUBLICATIONS https://www.businessinsider.com/glider-magnetic-window-cleaner-life-hack-2018-2, Feb. 15, 2018.
Tyroler Bright Tools, ""Adjustable Series: The Glider D4 AFC | Fit To 2-40 mm / 0.1"-1.6" Window Thick"". May 13, 2020, https://tyrolerltd.com/magneticwindow-cleaner/the-glider-d-4.
https://www.youtube.com/watch?v=u1ZkiPhz86I&feature=emb_logo, May 10, 2020.

* cited by examiner

WINDOW CLEANING DEVICE

TECHNOLOGICAL FIELD

The present disclosure is in the field of cleaning tools, in particular tools for cleaning windows.

BACKGROUND ART

References considered to be relevant as background to the presently disclosed subject matter are listed below:

http://www.youtube.com/watch?v=SMI_AiEa0Jg&feature=emb_title&ab_channel=TyrolerBrightTools;

http://www.businessinsider.com/glider-magnetic-window-cleaner-life-hack-2018-2.

BACKGROUND

Cleaning windows from both sides may be challenging, in particular when the external surface of the window is not easily accessible. To ease the cleaning process a two-members device is typically used, having an internal member and an external member sandwiching the window and maintaining the grip of the window by magnetic attraction forces applied between the members. These devices are substantially made of rigid plastic that may potentially damage the window during the cleaning process. Furthermore, unintentional coupling of the two members may easily result in an injury of the user if a body part is getting trapped between the plastic members.

GENERAL DESCRIPTION

The present disclosure discloses a window cleaning device for cleaning a window. The device is constituted by two cleaning units, each is configured to be attached to a different side of the window due to attraction force of the other cleaning unit. from the other side of the window. The attraction force is applied by magnetic members that are embedded in each of the cleaning units and each of them is configured to be magnetically coupled with at least one magnetic member of the other unit. Once the cleaning units are attached to the window, the window is engaged either by integral wipers of the cleaning unit and/or cleaning cloths attachable to the cleaning units to perform the cleaning process by the device. The cleaning process is performed by movement of one of the cleaning units that is accessible by a user, i.e. the cleaning unit that is at the internal side of the window. A movement of one cleaning unit results in a respective movement of the other unit, i.e. the two cleaning units perform a conjugated movement over the window during the cleaning process. The cleaning units are each a single-piece molded article made of rubber, silicone rubber, elastomeric material, or a thermosetting material, namely a relatively soft material, softer than the plastic material forming the known window cleaning devices. This results in a window cleaning device having a less destructive potential for the window compared to plastic-based device that can cause scratches and other damages to the window during the cleaning process or can damage the window during the attachment of the device to two sides of the window. A plastic-based window cleaning device can easily cause damage to a window during the attachment of the two units of the device to the window due to the strong magnetic attraction between the units and the relative rigidity of the plastic. Furthermore, since the material that the cleaning units are made of is relatively soft (compared to common plastic-based devices), the risk of being injured due to unintentional magnetic coupling of the two units is dramatically reduced. Moreover, the softness of the material of the units of the cleaning devices, eliminates the risk of their breakage while accidently falling from the window during a cleaning process, unlike plastic devices which tend to break when they fall.

Thus, an aspect of the present disclosure provides a device for cleaning a window with inner and outer surfaces. The device includes a first cleaning unit for cleaning the inner surface and a second cleaning unit for cleaning the outer surface of the window. Each of the cleaning units includes (i) a base member, which is generally elongated and planar, extending between first and second ends and including a first, window-facing face that faces the window during cleaning process and a second, opposite face, facing away from the window; (ii) at least two members of a magnetic couple, magnetically engageable with respective couple members in the other unit. Each of the members of the magnetic couple are either integrated within the base member or housed within a magnet-receiving element of the base member; (iii) a cleaning arrangement selected from at least one of: (1) two cloth fastening arrangements for allowing fastening two portions of a cleaning cloth such that the cloth extends over the first face, and/or (2) integral wipers extending, at least partially, along the long edge of the cleaning units between the first and second ends.

The first and second cleaning units is a single-piece molded article made of rubber, silicone rubber, elastomeric material, or a thermosetting material, preferably rubber or silicon rubber. It is to be noted that the magnet members are not part of the single-piece molded article and are only housed within the cleaning units or being surrounded by the molded material.

In some embodiment of the device, the first and second cleaning units are single-piece molded articles made of rubber.

In some embodiment of the device, the first and second cleaning units are single-piece molded articles made of silicon rubber.

In some embodiments of the device, the first and second cleaning units are single-piece molded articles made of an elastomeric material.

In some embodiments of the device, each of the cleaning units includes two magnet-receiving elements for housing the members of the magnetic couple, each magnet-receiving element houses one magnetic member.

In some embodiments of the device, the magnet-receiving elements are having a bore with dimensions adapted to accommodate the member of the magnetic couple.

In some embodiments of the device, the bore is defined between a bottom end and a top end of the magnet-receiving element.

In some embodiments of the device, the bottom end is constituted by a part of the base member. In some embodiments, the bottom end constitutes a part of the second face.

In some embodiments of the device, each of the bores is sealed by a respective closure element being fixedly attached to the top end of the respective bore, thereby trapping the member of the magnetic couple within the bore. The magnets that are housed within the bore can be glued, attached, merely placed at the bottom part of the bore, or can be adjustably displaced along the bore by a magnet-adjustment assembly.

In some embodiments of the device, the closure includes a metal plate covered or coated with rubber, silicone rubber, elastomeric material, or a thermosetting material.

In some embodiments of the device, the first cleaning unit is fitted with a magnet-adjustment assembly for allowing adjustment of the position of the magnet along said bore. The magnet-adjustment assembly is typically not being a part of the single-piece molded article and is being attached to the first cleaning unit.

In some embodiments of the device, the magnet-adjustment assembly includes the closure element, namely the closure element is being part of the magnet-adjustment assembly.

In some embodiments of the device, the magnet-adjustment assembly includes adjustment actuator, e.g. a knob, for allowing said adjustment. At least portion of the adjustment actuator is coated or covered with rubber, silicone rubber, elastomeric material, or a thermosetting material.

The parts of the magnet-adjustment assembly and the closure elements that are exposed to the user are coated with a soft material, typically the same material forming the cleaning units. By that, any exposed part of the device is covered by a relatively soft material to provide the advantages of the window cleaning device, as described above.

In some embodiments of the device, each of the base members is generally planar.

In some embodiments of the device, each of the base members is rectangular.

In some embodiments of the device, each of the base members includes one or more integral wipers, being a part of the single-molded article and extending at least partially between the first and second ends and are configured for engaging the window. Specifically, the wiper includes a window-engaging edge that is intended to contact the window. The wipers are designed to protrude from the window-facing face of the base member such that only the wipers, and not any other part of the cleaning unit, contact the window upon cleaning.

In some embodiments of the device, the window-facing face defining a plane and the wipers cross said plane, namely the wipers extend from one side of the plane to the other side of the plane.

In some embodiments of the device, the wipers constitute edges of the base members, e.g. extend along at least part of a long edge of the base member. Namely, the wipers are forming the side edges of the cleaning units.

For the wipers to operate efficiently, they need to have a rigid base that provides a counter force when they are urged against the surface to be cleaned, e.g. a window. Thus, the base of the wipers is either formed of a thick molded material and/or includes a reinforcing rigid element.

In some embodiments of the device, the molded material thickness of the base of the wiper is greater than the thickness of the base member part between the wipers.

In some embodiments of the device, each of the cleaning units includes an elongated rigid element embedded in the base member along each of the integral wipers and at least partially extending parallel to the wiper between the first and second ends for supporting the wiper and granting it the required rigidity. The cleaning unit is molded around said rigid element.

In some embodiments of the device, the fastening arrangements are defined by slits at the base members. Namely, the fastening arrangements are formed by the shape of the molded article, or by apertures formed thereon.

In some embodiments of the device, each of the cleaning units includes reinforcing ribs formed at the window-facing face for increasing rigidity of the base member.

In some embodiments of the device, a security rope or thread is tied at one end to a portion of the second unit and intended to be tied to a static object at its other end to secure the second, external cleaning unit when it accidently falls from the window during a cleaning process. In the same manner, a second rope or thread can be tied to a portion of the first cleaning unit.

Yet another aspect of the present disclosure provides a device for cleaning a window with inner and outer surfaces. The device includes a first cleaning unit for cleaning the inner surface and a second cleaning unit for cleaning the outer surface of the window. Each of the cleaning units includes: (i) a base member being generally elongated and planar and extending between first and second ends and comprising a first, window-facing face that faces the window during cleaning and a second, opposite face; (ii) a magnet-receiving element, typically having a tubular shape, protruding from the base member and configured to house at least two members of a magnetic couple, magnetically engageable with respective couple members in the other unit; (iii) two cloth fastening arrangements for allowing fastening two parts of a cleaning cloth such that the cloth extends over the first face.

Each of the first and second cleaning units is a single-piece molded article made of rubber, silicone rubber, elastomeric material, or a thermosetting material. It is to be noted that the magnet members are not part of the single-piece molded article.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 5A is a side view and FIG. 5B is a perspective view. The molded material forming the cleaning units is shown as semi-transparent.

DETAILED DESCRIPTION OF EMBODIMENTS

The following figures are provided to exemplify embodiments and realization of the invention of the present disclosure.

Figure 1A:
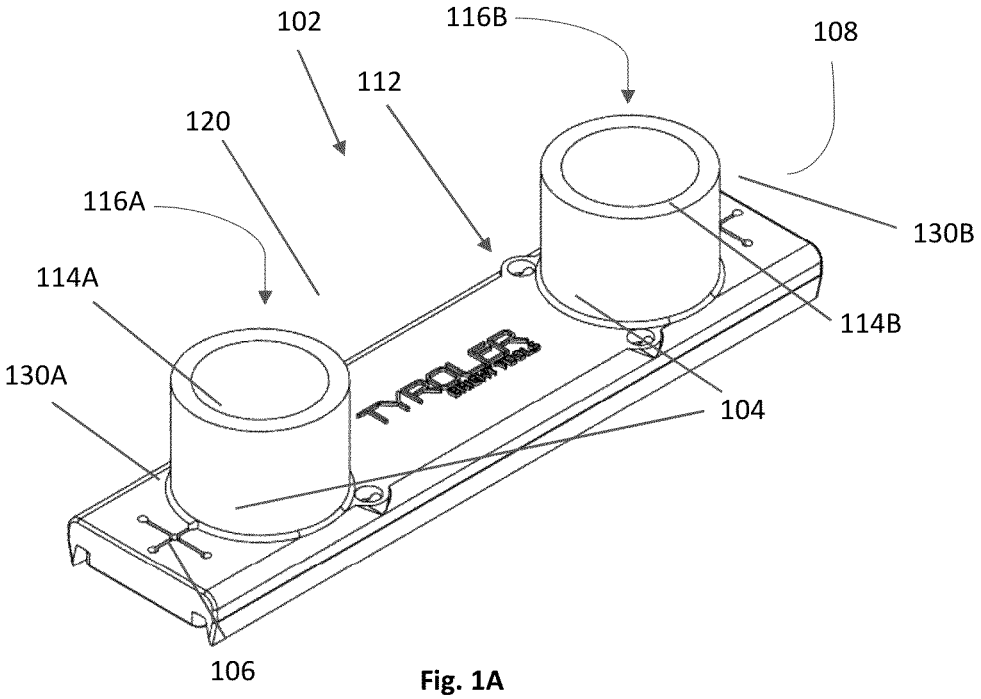
FIGS. 1A-1B are schematic illustrations of perspective views of a non-limiting example of the first cleaning unit out of two forming the window cleaning device according to the present disclosure.
Figure 1B:
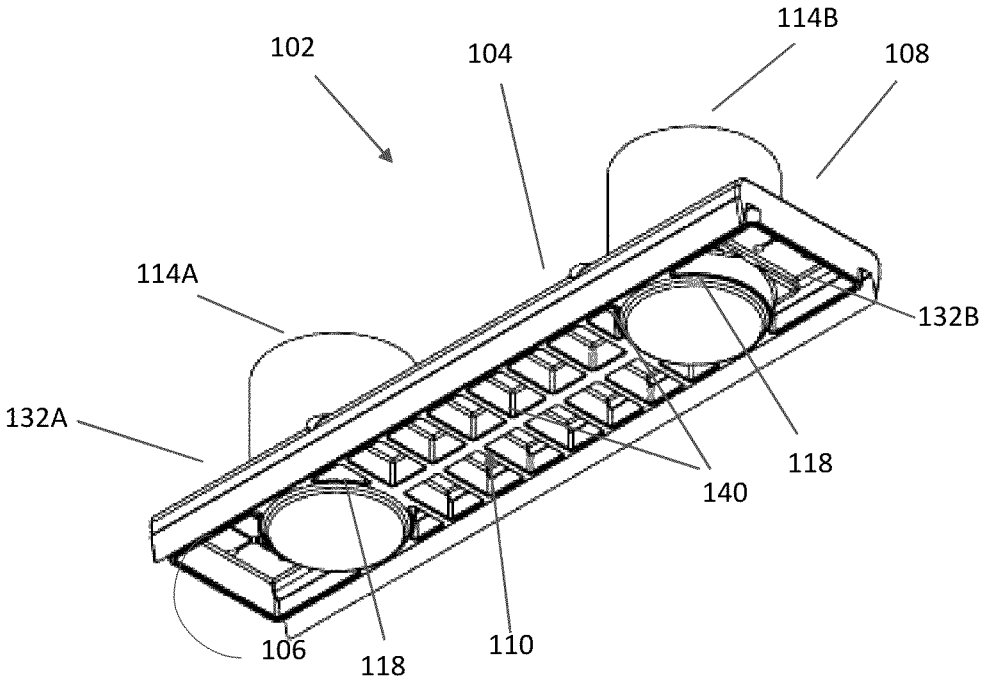
Figure 2A:
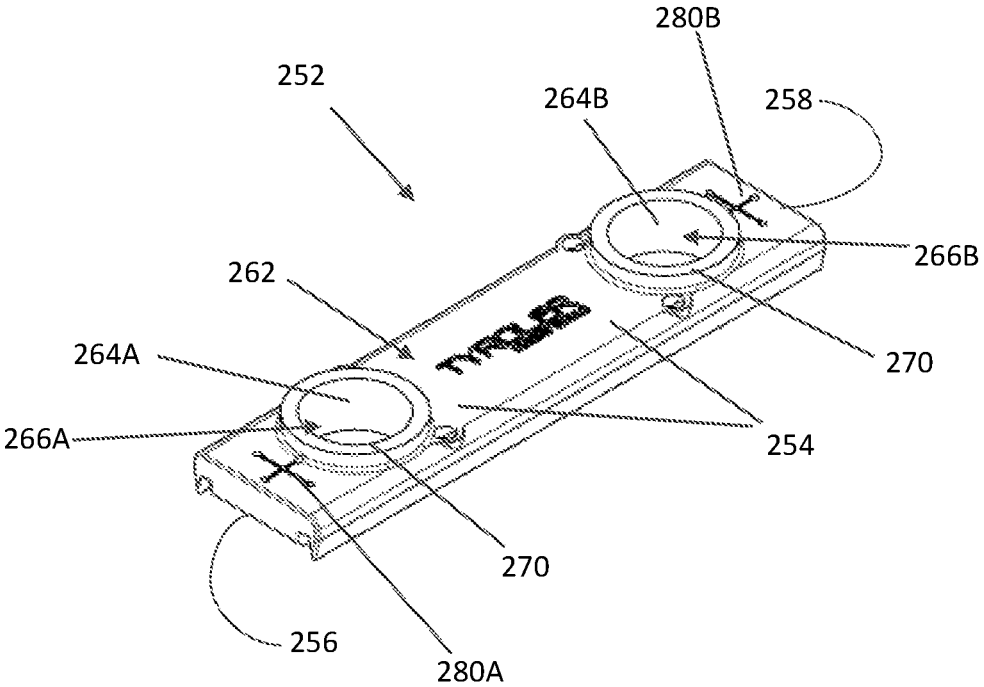
FIGS. 2A-2B are schematic illustrations of perspective views of a non-limiting example of the second cleaning unit out of two forming the window cleaning device according to the present disclosure.
Figure 2B:
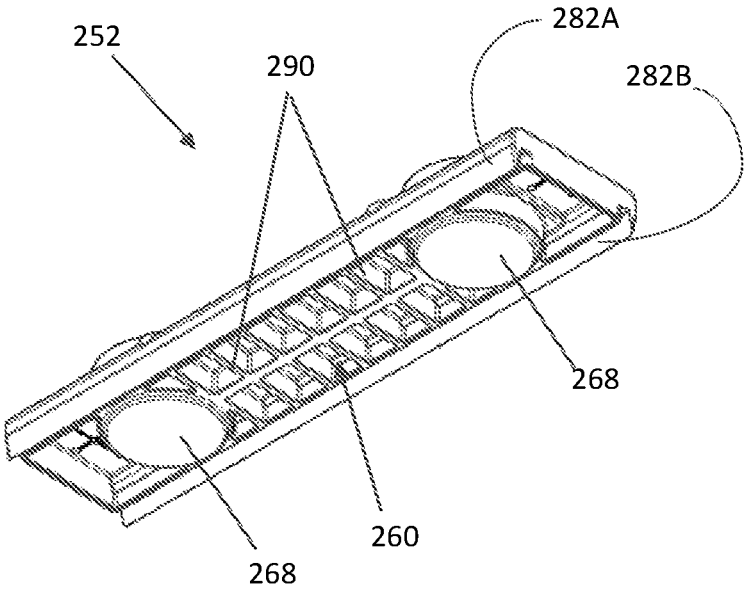

Reference is first being made to FIGS. 1A-1B and 2A-2B, which are schematic illustrations of perspective views of the first and second cleaning units of the device for cleaning a window of the present disclosure. The first and second cleaning units defining together the cleaning device and are configured to be magnetically coupled to one another from two sides of a window, and each is configured to clean one side of the window. FIGS. 1A-1B show the top and bottom views of the first cleaning unit, respectively; FIGS. 2A-2B show the top and bottom views of the second cleaning unit, respectively. Each of the cleaning units is a single-piece molded article made of rubber, silicone rubber, elastomeric material, or a thermosetting material. The first cleaning unit 102 includes a base member 104 that extends between a first end 106 and a second end 108, the second cleaning unit 252 includes a base member 254 that extends between a first end 256 and a second end 258. It is to be noted that numerical references of 1XX refer to the first cleaning unit and the numerical references of 2XX refer to the second cleaning unit. The base members 104, 254 include a first, window-facing face 110, 260 and a second face 112, 262 opposite to the first face and facing away from the window. Two magnet-receiving elements 114A, 264A and 114B, 264B are formed on the second face 112, 262 on generally opposite sides of the base members 104, 254 namely one 114A, 264A is adjacent to the first end 106, 256 and the other 114B, 264B is adjacent to the second end 108, 258. Each of the magnet-receiving elements 114A, 264A and 114B, 264B is tubular defining a bore 116A, 266A and 116B, 266B extending between a bottom end 118, 268 of the respective magnet-receiving element and a top end 120, 270 thereof and dimensioned to accommodate a member of a magnetic couple.

In the figures throughout the application, like elements of different figures were given similar reference numerals shifted by the number of hundreds corresponding to the number of the respective figure. For example, element 316 in FIG. 3 serves the same function as element 116 in FIGS. 1A-1B.

Figure 3:
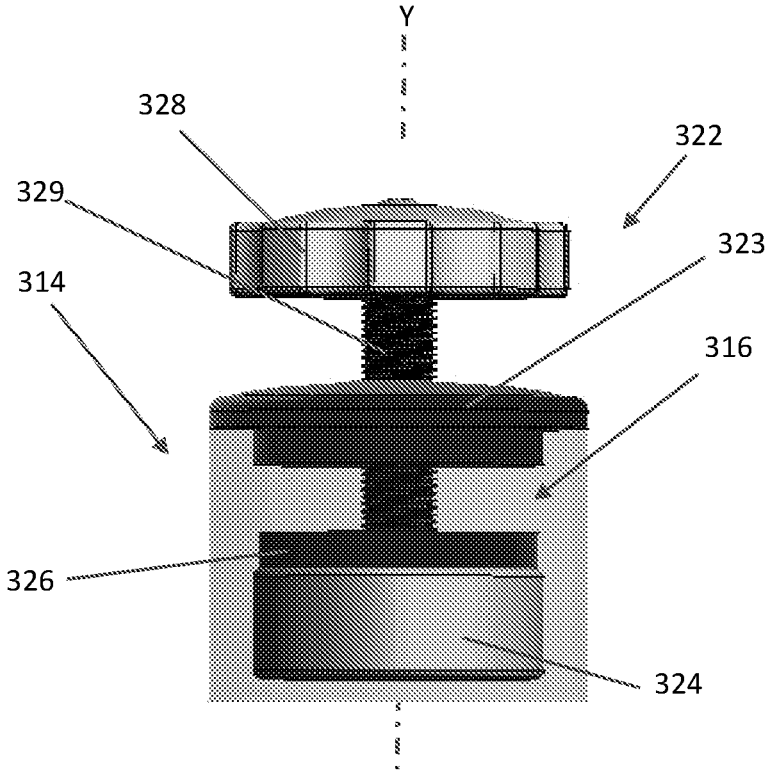
FIG. 3 is an illustration of a magnet adjustment assembly accommodated in a bore of a magnet receiving element that is included in the first cleaning unit of the window cleaning device of the present disclosure. The molded material forming the magnet receiving element is shown as semi-transparent.

Reference is now being made to FIG. 3, which is an illustration showing an example of the magnet-receiving element 314 of the first cleaning unit, which its walls are presented as semi-transparent, showing a magnet-adjustment assembly 322 that is received in the bore 316 and configured to adjust the position of the magnet 324 along an axis Y normal to the first and second faces. The bore 316 is sealed by a closure element 323, confining the magnet 324 within the bore 316. The magnet-adjustment assembly 322 comprises a disc 326 that is confined within the bore 316 and is displaceable along axis Y by using a knob 328 disposed externally to the bore and is integral with the disc 326 via a column 329 passing through the closure element 323. The column is screwable through the closure element 323 to allow the displacement of the disc 326. The magnet 324 is attached to the disc 326 that is formed at the bottom of the magnet-adjustment assembly 322 and is displaceable therewith, thereby allowing displacement of the magnet along axis Y to the desired position, e.g. at the bottom of the bore to obtain strong magnetic attraction with the respective magnetic member or at the top of the bore to obtain weak magnetic attraction. The attachment can be magnetically or by gluing the magnet to the disc. It is to be noted, that the magnet-receiving elements of the second cleaning unit are merely designed to accommodate the magnetic member and typically does not include an adjustment assembly. A closure element, e.g. a lid, fits over the top end of the bore to seal the magnetic member within the bore. The knob 328 and the closure element 323 are covered by a soft material, for example a silicon or a silicon rubber that forms the cleaning unit the magnet adjustment assembly is coupled to.

Referring back to FIGS. 1A-1B and FIGS. 2A-2B, the base member 104, 254 is formed with two slits 130A, 280A and 130B, 280B, each is disposed between a respective magnet-receiving element 114A, 264A and 114B, 264B and the first end 106, 256 or the second end 108, 258, respectively. Namely, slit 130A, 280A is disposed between magnet-receiving element 114A, 264A and the first end 106, 256 and slit 130B, 280B is disposed between magnet-receiving element 114B, 264B and the second end 108, 258. The slits 130A, 280A and 130B, 280B are each configured for receiving and retaining a portion of a cleaning cloth (not shown) such that it extends over the bottom face 110, 260 of the cleaning unit 102, 252.

Figure 4:
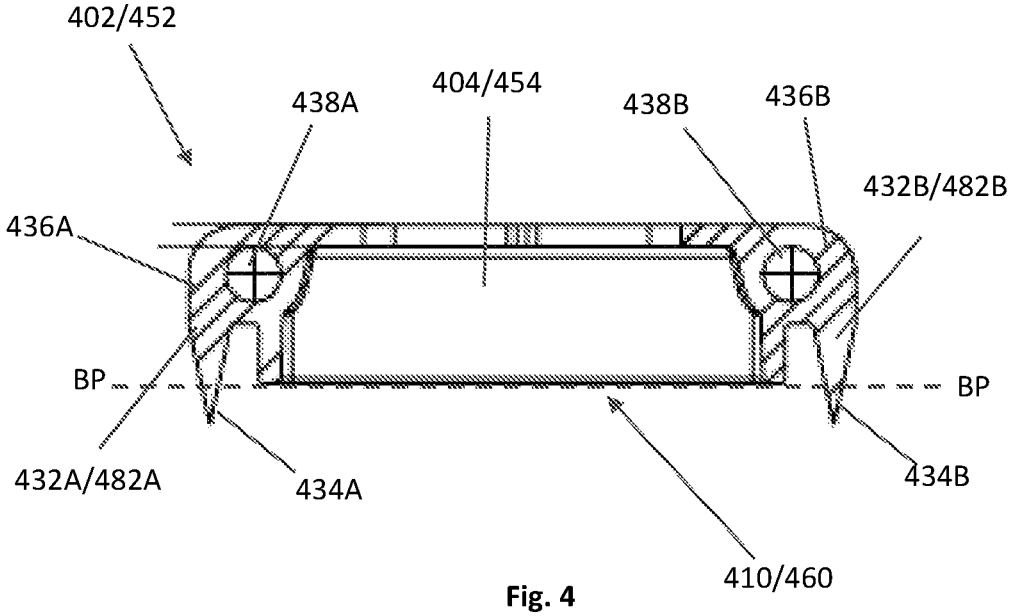
FIG. 4 is a schematic illustration of a longitudinal cross section of a non-limiting example of the base members of the cleaning units of the device of the present disclosure.

The cleaning unit 102, 252 includes two integral wipers 132A, 282A and 132B, 282B that are being part of the base member 104, 254 and constitute its edges. The wipers 132A, 282A and 132B, 282B extend, each on opposite side to the other, between the first end 106, 256 and the second end 108, 258. Reference is now being made to FIG. 4, which exemplifies a longitudinal cross section of the base member of the first and the second cleaning units. It is to be noted that the following description of FIG. 4 applies to both the first and the second cleaning units. As can be appreciated, the wipers 432A/482A and 432B/482B constitute the side edges of the cleaning unit. The wipers have a window-engaging portion 434A and 434B and a base portion 436A and 436B. Each of the wipers comprises a rigid element 438A and 438B that is formed at its base portion 436A and 436B, respectively. The rigid elements extend, at least partly, between the first end and the second end of the cleaning unit 402/452, together with the wipers. The rigid elements grant the wipers their rigidity, such that when they engage the window, they do not fold or squeeze. As can be appreciated in FIG. 4, the bottom face 410/460 of the base member 404/454 defines a bottom plane BP, the wipers 432A/482A and 432B/482B are crossing the bottom plane BP. Namely, the window engaging portion of each of the wipers is at one side of the plane and the base portion of each of the wipers is at the other side of the bottom plane BP. This allows that the wipers 432A/482A and 432B/482B are the only elements that engage the window during the cleaning process.

Referring back to FIGS. 1A-1B and 2A-2B, the bottom face 110, 260 is formed with reinforcing ribs 140, 290. The reinforcing ribs 140, 290 are typically formed between the bottom ends 118, 268 of the magnet-receiving elements 114A, 264A and 114B, 264B. The reinforcing ribs 140, 290 grants the base member additional rigidity that is required due to the forces that are being applied thereon during the cleaning process due to the strong magnetic attraction between the first and the second cleaning units.

It is to be noted, that in some embodiments, the cleaning device is formed of two identical cleaning units. The two cleaning units can be of the type of the first cleaning unit or preferably of the type of the second cleaning unit, namely two units without a magnet-adjustment assembly.

Figure 5A:
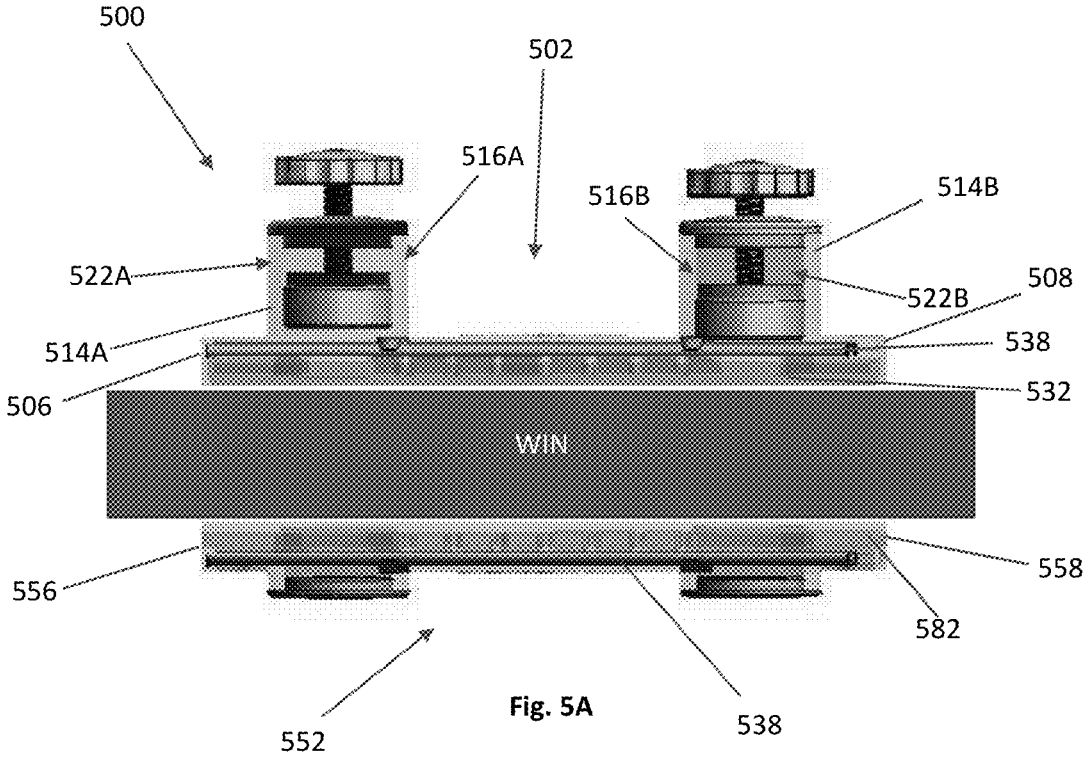
FIGS. 5A-5B are illustrations of a non-limiting example showing the two cleaning units forming the window cleaning device, facing one another with a window partitioning between them. These figures illustrate the device during a cleaning process.
Figure 5B:
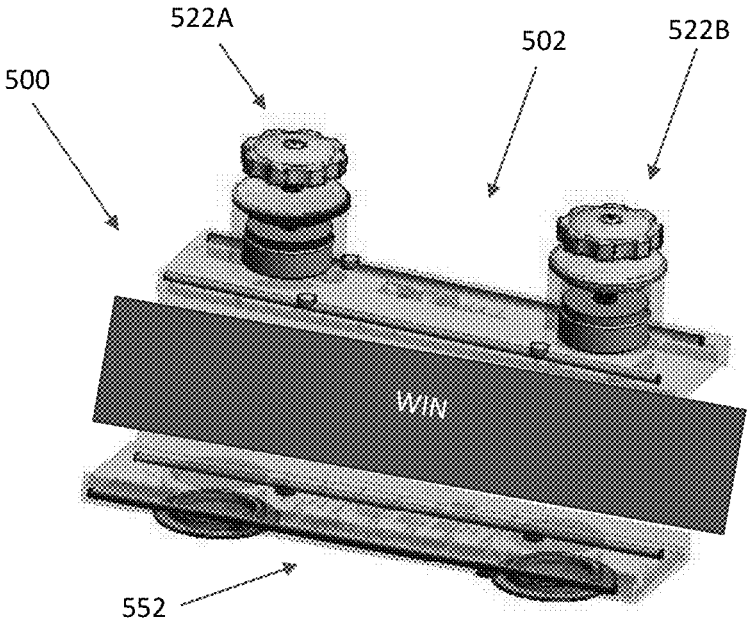

FIGS. 5A-5B are illustrations of different views of a non-limiting example of the cleaning device 500 of the present disclosure. In these figures, the first and the second units 502 and 552 are shown facing one another, each from a different side of the window WIN they are cleaning. The cleaning units are formed of a single-piece molded article made of rubber, silicone rubber, elastomeric material, or a thermosetting material, the molded article material is presented in the figure as semi-transparent thereby showing internal parts (at least some of them are not typically visible to the naked eye). Particularly, the magnet-adjustment assemblies 522A and 522B of the first cleaning unit 502 are shown, disposed within the bores 516A and 516B of the magnet-receiving elements 514A and 514B; and the rigid elements 538 that extend together with the wipers 532, 582 of the first and second cleaning units 502 and 552. As can be appreciated, the rigid elements 538 extend between the majority of the length between the first end 506, 556 and the second end 508, 558 of the cleaning units.

The invention claimed is:

1. A device for cleaning a window with inner and outer surfaces, comprising:

a first cleaning unit for cleaning the inner surface and a second cleaning unit for cleaning the outer surface of the window, each of which comprises a base member extending between first and second ends and comprising a first, window-facing face and a second, opposite face, a magnetic couple that comprises two members, magnetically engageable with respective couple members in the other unit, each of which being integrated within the base member or housed within a respective magnet-receiving element of the base member, two wipers integral with the base member and extending at least partially between said first and second ends and are configured for engaging the window;

wherein each of the first and second cleaning units is a single-piece molded article made of rubber or silicone rubber;

wherein said wipers constitute edges of the base members.

2. The device of claim 1, wherein each of the cleaning units comprises two magnet-receiving elements, each for housing a member of the magnetic couple.

3. The device of claim 2, wherein said magnet-receiving elements have a bore configured to accommodate the member of the magnetic couple.

4. The device of claim 3, wherein said bore is defined between a bottom end and a top end of the magnet-receiving element.

5. The device of claim 4, wherein said bottom end is formed within the base member.

6. The device of claim 4, wherein the bottom end constitutes a part of the second face.

7. The device of claim 6, wherein the closure comprises a metal plate covered with a metal plate cover material selected from any one of: rubber, silicone rubber, elastomeric material, or a thermosetting material.

8. The device of claim 3, wherein each of the bores is sealed by a respective closure element being fixedly attached to a top end of the respective bore, thereby trapping the member of the magnetic couple within the bore.

9. The device of claim 3, wherein the first cleaning unit is fitted with a magnet-adjustment assembly for allowing adjustment of the position of the magnet along said bore.

10. The device of claim 9, wherein the magnet-adjustment assembly comprises said closure element.

11. The device of claim 9, wherein the magnet-adjustment assembly comprises an adjustment actuator for allowing said adjustment, said adjustment actuator is at least partly coated with rubber, silicone rubber, elastomeric material, or a thermosetting material.

12. The device of claim 1, wherein said window-facing face defining a plane, said wipers cross said plane.

13. The device of claim 1, wherein each cleaning unit comprises an elongated rigid element embedded in the base member along each of the integral wipers.

14. The device of claim 1, wherein each cleaning unit comprises reinforcing ribs formed at the window-facing face.

15. The device of claim 1, wherein each of the first and second cleaning units comprises two cloth fasteners for allowing fastening two parts of a cleaning cloth such that the cloth extends over the first face.

16. A device for cleaning a window with inner and outer surfaces, comprising:

a first cleaning unit for cleaning the inner surface and a second cleaning unit for cleaning the outer surface of the window, each of which comprises a base member extending between first and second ends and comprising a first, window-facing face and a second, opposite face, two magnet-receiving elements protruding from the base member and configured to house a magnetic couple that comprises two members, magnetically engageable with respective couple members in the other unit, the two magnet-receiving elements are defined between a bottom end, being a part of the window-facing face, and a top end, two cloth fasteners for allowing fastening two parts of a cleaning cloth such that the cloth extends over the first face;

two wipers integral with the base member and extending at least partially between said first and second ends and are configured for engaging the window;

wherein said wipers constitute edges of the base members;

wherein each cleaning unit comprises an elongated rigid element embedded in the base member along each of the integral wipers, wherein each of the cleaning units is molded around said rigid element;

wherein each cleaning unit comprises reinforcing ribs formed at the window-facing face, the reinforcing ribs are formed between the bottom ends of the magnet-receiving elements;

wherein each of the first and second cleaning units is a single-piece molded article made of rubber, silicone rubber, elastomeric material or a thermosetting material.

* * * * *